US011158997B2

(12) United States Patent
Herriges et al.

(10) Patent No.: US 11,158,997 B2
(45) Date of Patent: Oct. 26, 2021

(54) SPARK PLUG AND MANUFACTURING METHOD THEREOF

(71) Applicant: NANO SPARK INC., Toronto (CA)

(72) Inventors: Thomas L. Herriges, St. Louis, MO (US); Mark Farrell, Toronto (CA); Ghabi Neame, Brampton (CA); Robert Keith Sim, Georgetown (CA); Carlos Fernandes, Toronto (CA); Harry E. Ruda, Toronto (CA)

(73) Assignee: NANO SPARK, INC., Toronto (CA)

( * ) Notice: Subject to any disclaimer, the term of this patent is extended or adjusted under 35 U.S.C. 154(b) by 0 days.

(21) Appl. No.: 16/323,740

(22) PCT Filed: Aug. 8, 2017

(86) PCT No.: PCT/US2017/045934
§ 371 (c)(1),
(2) Date: Feb. 6, 2019

(87) PCT Pub. No.: WO2018/031563
PCT Pub. Date: Feb. 15, 2018

(65) Prior Publication Data

US 2020/0388993 A1 Dec. 10, 2020

Related U.S. Application Data

(60) Provisional application No. 62/372,098, filed on Aug. 8, 2016, provisional application No. 62/464,897, filed
(Continued)

(51) Int. Cl.
*H01T 13/32* (2006.01)
*H01T 13/46* (2006.01)
(Continued)

(52) U.S. Cl.
CPC ..... *H01T 13/32* (2013.01); *H01T 13/08* (2013.01); *H01T 13/39* (2013.01); *H01T 13/467* (2013.01); *H01T 21/02* (2013.01)

(58) Field of Classification Search
CPC combination set(s) only.
See application file for complete search history.

(56) References Cited

U.S. PATENT DOCUMENTS

2006/0055298 A1 3/2006 Kanao
2009/0309474 A1 12/2009 Nunome
(Continued)

FOREIGN PATENT DOCUMENTS

JP 07-147179 A 6/1995

OTHER PUBLICATIONS

Inrernational Search Report dated Nov. 22, 2017.

*Primary Examiner* — Donald L Raleigh
(74) *Attorney, Agent, or Firm* — Dinsmore & Shohl LLP

(57) ABSTRACT

A spark plug for use with an engine block/cylinder head having a threaded bore and also for use with a spark plug wrench and an ignition wire. Also, an improved method for constructing a spark plug, the spark plug including a metal shell having a hex nut, a seat, a flange, a bore and threads. A ground electrode is associated with the shell and an insulator assembly occupies the bore and is gripped by the flange. The method includes the steps of forming the hex nut and the seat by carrying out operations on a blank, roiling the threads, fitting the insulator assembly into the bore, deforming the flange to capture the insulator, and forming the negative electrode by machining the blank.

18 Claims, 14 Drawing Sheets

Related U.S. Application Data on Feb. 28, 2017, provisional application No. 62/476, 244, filed on Mar. 24, 2017.

(51) Int. Cl.

| | |
|---|---|
| ***H01T 13/08*** | (2006.01) |
| ***H01T 13/39*** | (2006.01) |
| ***H01T 21/02*** | (2006.01) |

(56) References Cited

U.S. PATENT DOCUMENTS

| | | | | |
|---|---|---|---|---|
| 2012/0264344 | A1* | 10/2012 | Below | H01T 13/08 445/7 |
| 2014/0354137 | A1* | 12/2014 | Farrell | F02P 13/00 313/141 |
| 2015/0171599 | A1 | 6/2015 | Farrell et al. | |

* cited by examiner

SPARK PLUG AND MANUFACTURING METHOD THEREOF

CROSS-REFERENCE TO RELATED APPLICATIONS

The present application claims the priority of each of U.S. Ser. No. 62/372,098 filed Aug. 8, 2016, U.S. Ser. No. 62/464,897 filed Feb. 28, 2017, and U.S. Ser. No. 62/476,244, filed Mar. 24, 2017.

FIELD

The invention relates to the field of spark plugs. More particularly, the present invention teaches a spark plug apparatus and method for manufacturing a spark plug.

BACKGROUND

It is known to manufacture spark plugs. A known method involves the use of thick-walled tubular metal "blanks". The blanks can be constructed by extrusion, cold-forming and/or machining. Thereafter:

- secondary operations, such as knurling and machining, are carried out on the blank to form the hex nut portion, the seat and the flange to produce a preform;
- a wire is welded to the preform;
- threads are rolled onto the preform to form the shell;
- the insulator assembly is fitted in place;
- the body is produced by deforming the flange of the shell, to form a gas tight seal;
- the gasket is scrimped over the body; and
- finally, to form the proper gap, the center electrode is machine-trimmed and the wire is given a final bend, to form the ground electrode.

SUMMARY

Forming one aspect of the invention is an improved method for constructing a spark plug.

The spark plug is of the type which includes:

- a body having a hex nut, a seat, a flange, a bore and threads;
- a ground electrode associated with the body; and
- an insulator assembly occupying the bore and gripped by the flange.

The method is of the type which includes, as steps:

- forming the hex nut and the seat by carrying out operations on a blank;
- rolling the threads;
- fitting the insulator assembly into the bore; and
- deforming the flange to capture the insulator assembly.

The improvement comprises:

- forming the ground electrode by machining the shell.

According to another aspect, in the method, the ground electrode can be fully formed prior to fitting the insulator assembly into the bore.

According to another aspect, in the method, the ground electrode can be formed to include a cap portion to which the threaded part of the shell extends and which is disposed in spaced relation to the insulator assembly, the cap portion defining a void having:

- a central portion into which the center electrode extends;
- an annular channel surrounding the central portion; and
- a plurality of segments, equally spaced about the center electrode and each extending radially outwardly from the annular channel, and having:

- a central surface axially spaced from that portion of the insulator assembly that protrudes beyond the tubular portion; and
- a convex surface that surrounds and extends to the central surface.

According to another aspect, the central surface can be formed so as to be orientated substantially normally to the longitudinal axis and substantially coplanar with the end of the center electrode.

According to another aspect, the plurality of segments formed can consist of three to seven segments.

According to another aspect, the plurality of segments formed can be defined by a plurality of lobes, each being positioned with respect to the central portion in a manner analogous to the placement of the planet gears with respect to the sun gear in a planetary gear.

According to another aspect, the plurality of lobes formed can consist of seven lobes.

According to another aspect, the ground electrode can be machined with a 3-axis milling machine.

Forming another aspect of the present subject matter is an improved spark plug that may be formed using the above-noted method for constructing a spark plug. The improved spark plug is of the type which includes:

- a nut portion adapted to be turned by the wrench;
- a coupling portion extending from the nut portion and adapted to receive the ignition wire;
- an insulator portion extending from the nut portion and away from the coupling portion to an end;
- a positive electrode extending through and beyond the end of the insulator portion;
- a ground electrode including a tubular portion extending from the nut portion in surrounding relation to the insulator portion, the tubular portion being orientated coaxially about and defining a longitudinal axis and further being externally-threaded for engagement in the threaded bore in said engine block in use; and a plurality of blades, each blade: having a fixed end portion, defining a base cross-section area, integrally formed with the tubular portion; having a body extending axially away from the fixed end portion, and hence projecting radially inward towards the longitudinal axis; having a free end portion to which the body extends, the free end portion defining a face cross-sectional area presenting towards the positive electrode, which is less than the base cross-sectional area; and being radially spaced from the positive electrode.

Other advantages and features of the invention will become evident upon a review of the following detailed description and the appended drawings, the latter being briefly described hereinafter.

BRIEF DESCRIPTION OF THE DRAWINGS

For a better understanding of the present invention, and to show more clearly how it may be carried into effect, reference with now be made, by way of examples, to the accompanying drawings which show exemplary embodiments of the present invention in which:

FIG. 1I is a view along 11-11 of FIG. 10;

DESCRIPTION

Figure 1:
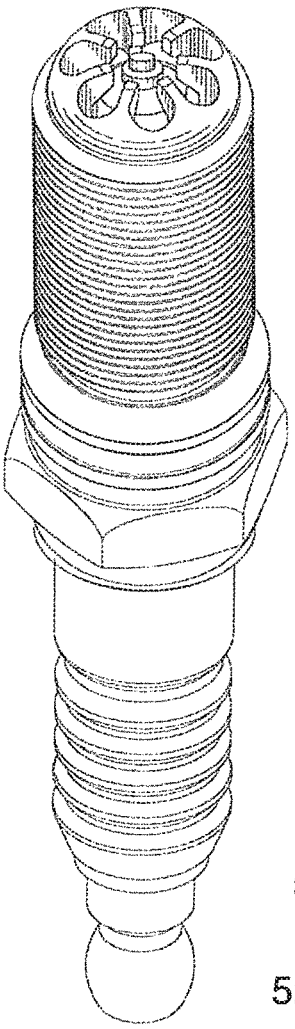
- FIG. 1 shows a prior art spark plug in perspective.

As an initial matter, it will be understood that, although the exemplary method described herein forms the spark plug 20 shown in FIGS. 1-3 and 13-14, the spark plug 20 shown forms no part of the present invention and, more particularly, the method is not limited to the construction of the spark plug 20 so shown. The present subject matter includes an exemplary improved spark plug 200, which may be formed using the exemplary method described herein.

Turning now to the spark plug 20, it will be understood to be for use with an engine block/cylinder head having a threaded bore and also for use with a spark plug wrench and an ignition wire, all as is conventional and not shown, and will be seen to include an insulator assembly, 22, a shell 24 and a ground electrode 26.

The insulator assembly 22 includes an end 28 adapted to receive the ignition wire and extends to a center electrode 30.

The shell 24 includes a hex nut portion 32, a threaded portion 34, a flange 36 and a central bore 38.

The hex nut portion 32 is adapted to be turned by the wrench (not shown).

The threaded portion 34 extends from the nut portion 32 and is adapted to be threaded into the bore (not shown).

The flange wraps 36 around and engages the insulator assembly 22 in the bore 38.

The ground electrode 26:

defines a void 40 having:

a central portion 42 into which the positive electrode extends;

an annular channel 44 surrounding central portion; and a plurality of segments 46, equally spaced about the center electrode, each segment extending radially outwardly from the annular channel and defining a lobe, the lobes being positioned with respect to the central portion in a manner analogous to the placement of the planet gears with respect to the sun gear in a planetary gear and has:

a plurality of radially inwardly disposed fingers 48 which separate the lobes from one another, each finger having:

a central surface 50 that is orientated substantially normally to the longitudinal axis; and a convex surface 52 that surrounds and extends from the threaded portion to the central surface.

Turning now to the inventive method, same will be understood to include steps which are somewhat conventional:

the hex nut and the seat are formed by carrying out operations on a blank;

the threads are rolled;

fitting the insulator assembly into the bore; and deforming the flange to capture the insulator.

Figure 4:
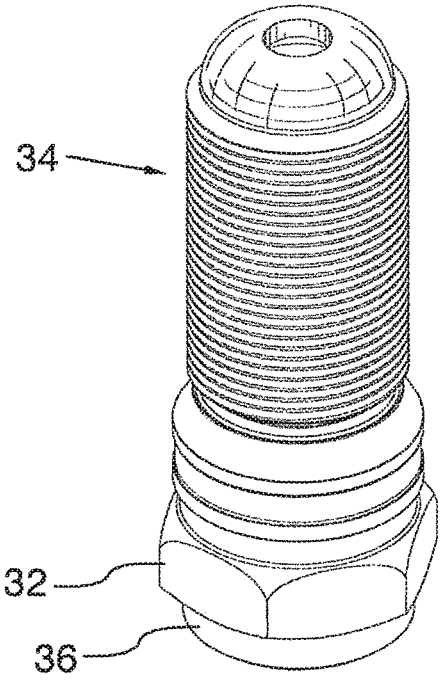
- FIG. 4 is a perspective view of a shell.
Figure 5:
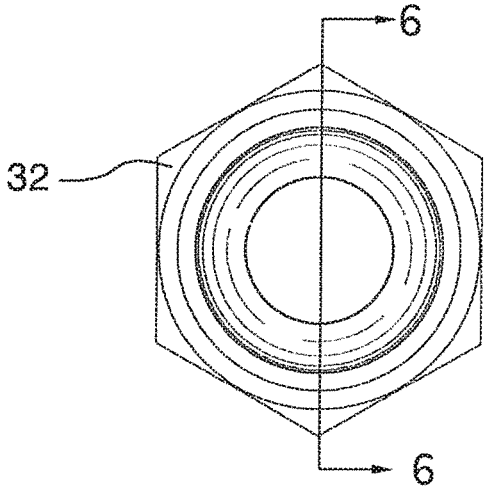
- FIG. 5 is an end view of the shell of FIG. 4.
Figure 6:
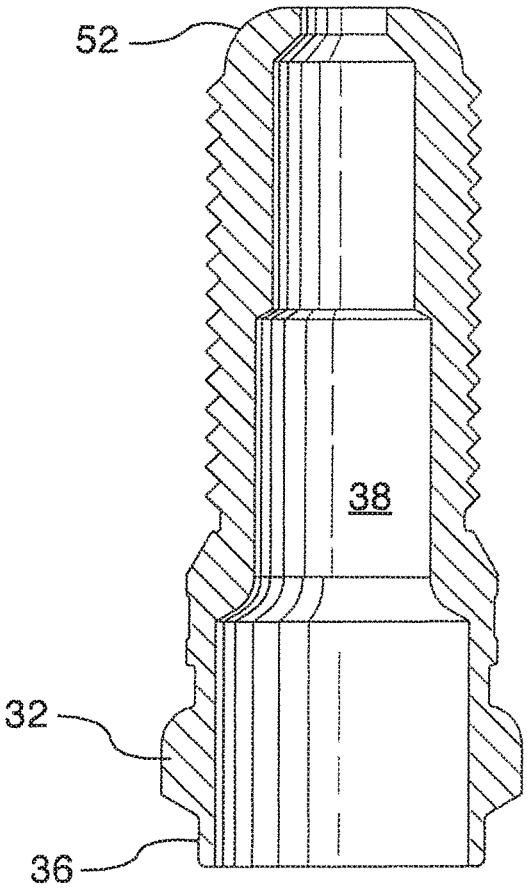
- FIG. 6 is a view along section 6-6 of FIG. 5.

However, whereas in the prior art, the ground electrode is formed by a welding a wire to the shell, in the exemplary embodiment, the ground electrode is formed by machining the shell using a 3-axis milling machine prior to fitting the insulator assembly into the bore, as shown by the sequence of FIGS. 4, 7, 11, 13:

FIGS. 4-6 shows the shell after secondary operations have been carried out with respect to a blank [not shown] to form the hex nut 32, flange 36 and threads 34

Figure 7:
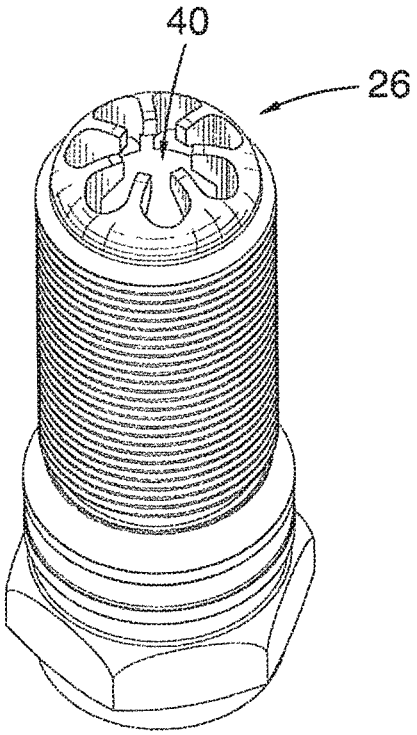
- FIG. 7 is a perspective view of a body.
Figure 8:
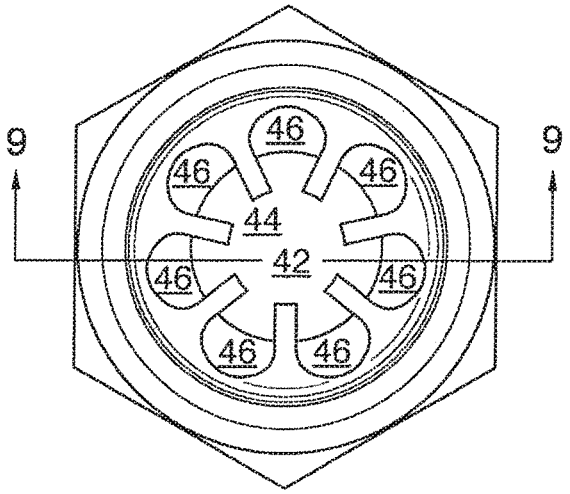
FIG. 8 is an end view of the body of FIG. 7.
Figure 9:
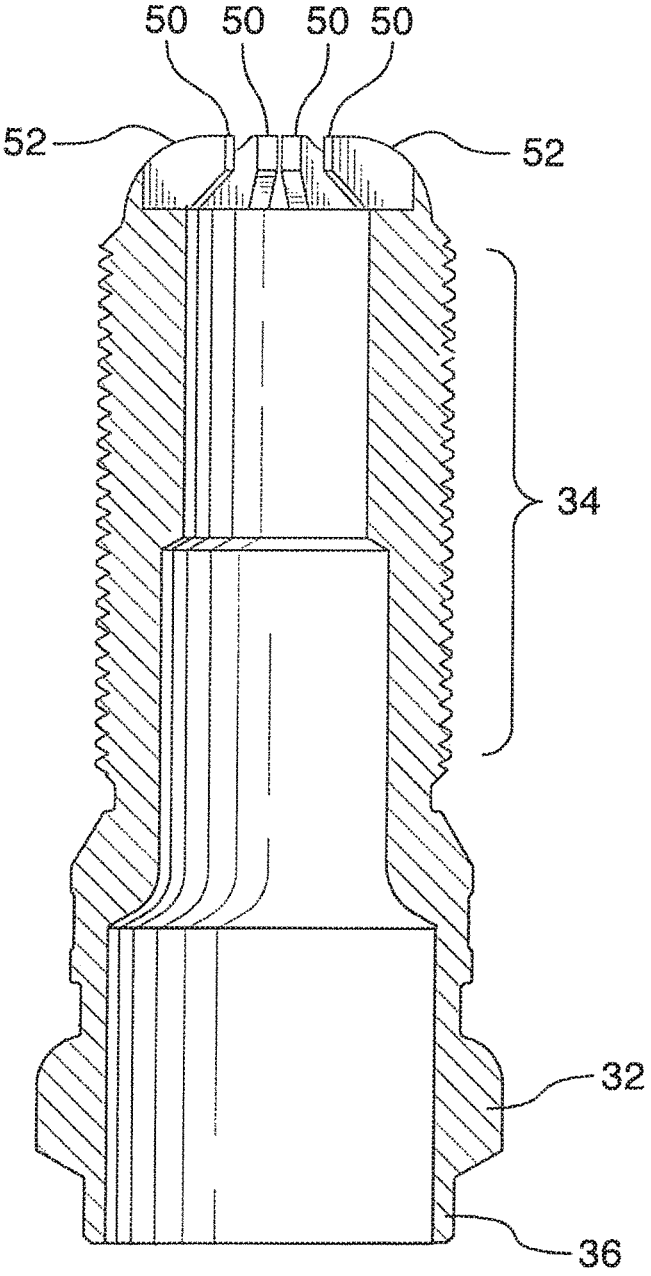
FIG. 9 is a view along section 9-9 of FIG. 8.
Figure 10:
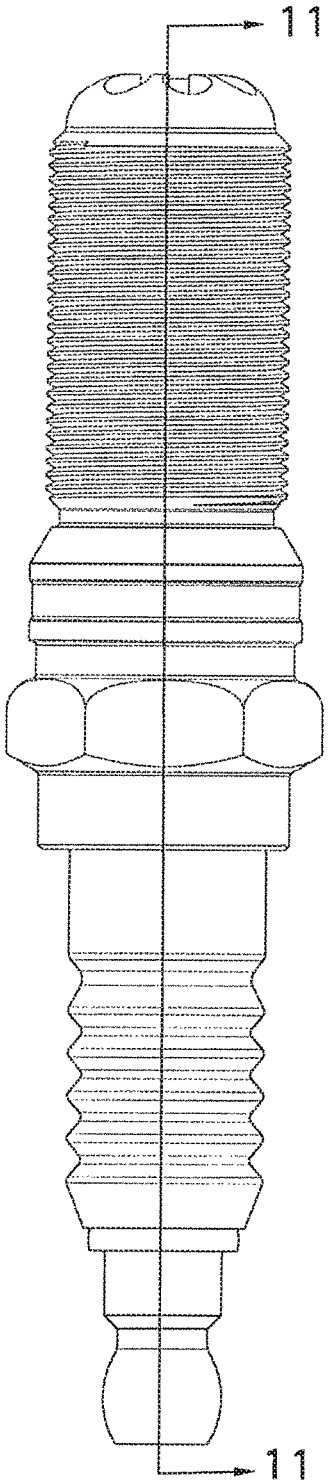
FIG. 10 is a view of the structure of FIG. 9 in receipt of the insulator assembly of FIG. 1.
Figure 11:
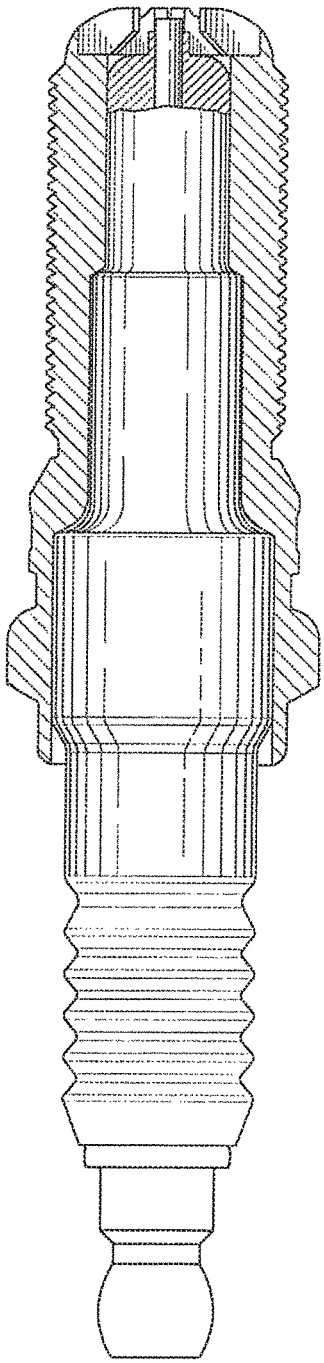
Figure 12:
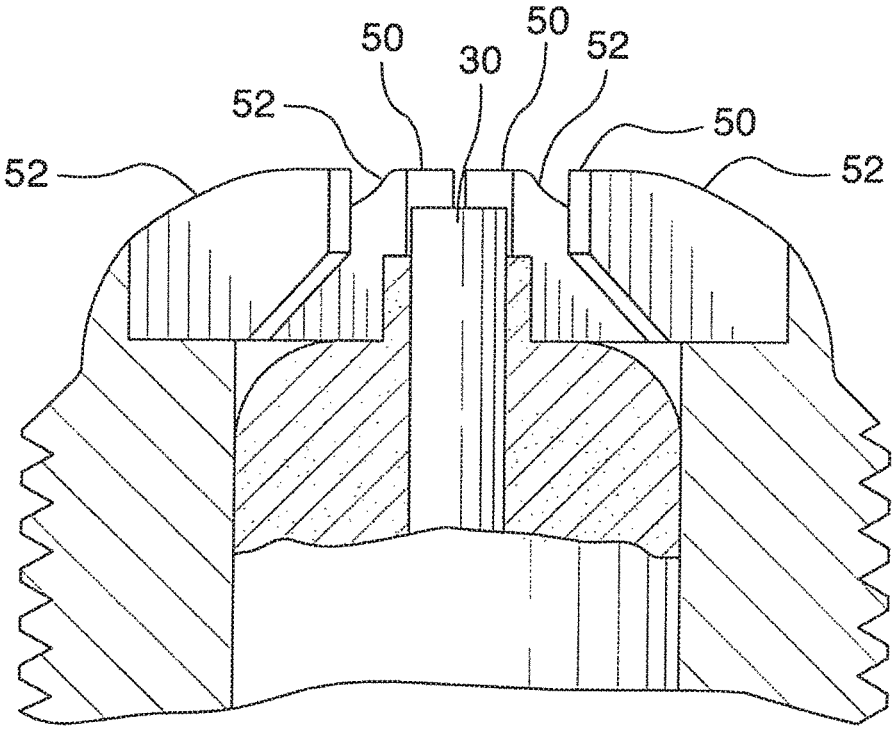
FIG. 12 is an enlarged view of encircled area 12 of FIG. 11.
Figure 13:
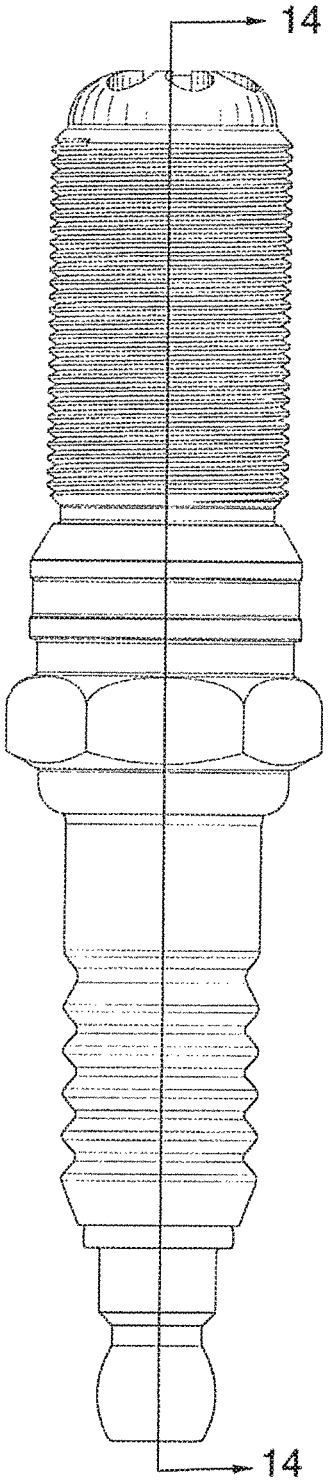
FIG. 13 is a view of the structure of FIG. 9 in sue of the insulator assembly of FIG. 1.
Figure 14:
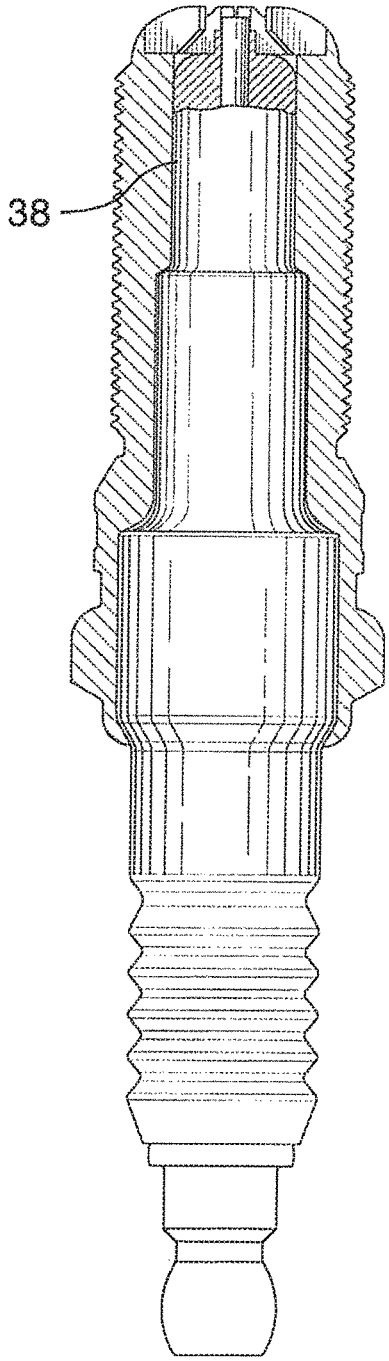
FIG. 14 is a view along section 14-14 of FIG. 13.
Figure 15:
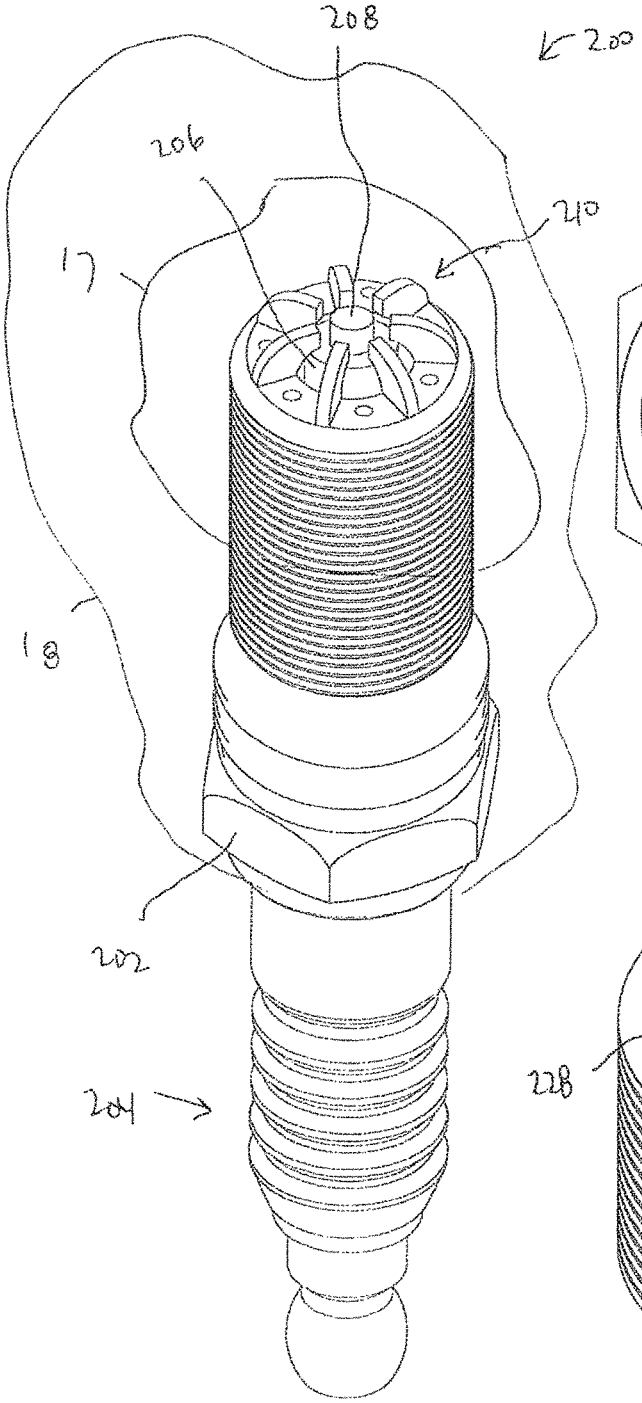
FIG. 15 is a perspective view of an improved spark plug according to another exemplary embodiments.
Figure 16:
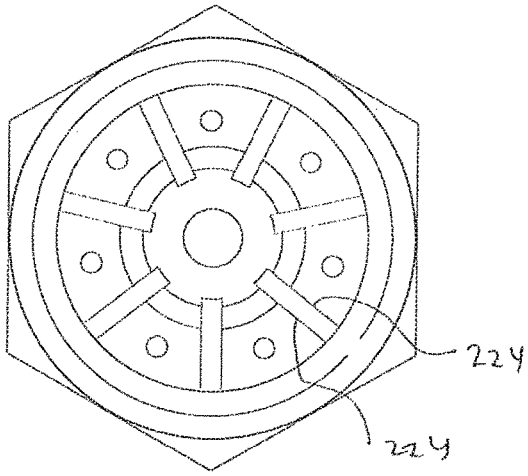
FIG. 16 is a top view of the structure of FIG. 15.

FIG. 7-9 shows the shell after the ground electrode 26 has been machined using a 3-axis milling machine FIGS. 10-12 show the insulator assembly 22 fitted into the shell 24;

FIGS. 13-14 show the flange 36 deformed to capture the insulator assembly 22

Persons of ordinary skill will readily appreciate the advantages associated with the present invention in that spark plugs of the general type shown in FIGS. 1-3 and 13-14 can be manufactured at relatively low cost with only minor modifications to existing spark plug manufacturing lines.

Figure 2:
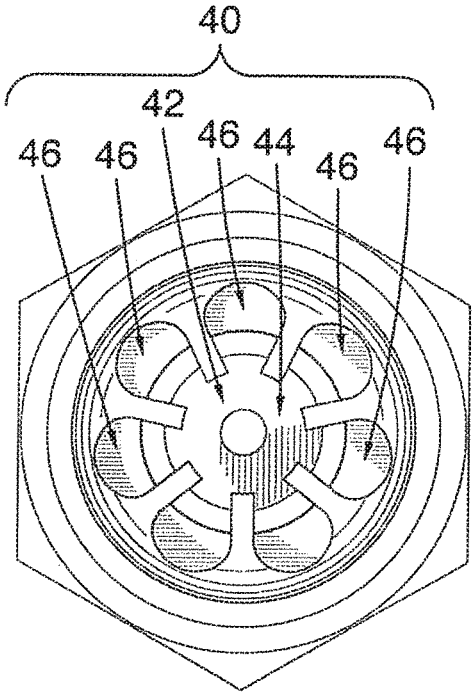
- FIG. 2 is an end view of the spark plug of FIG. 1.
Figure 3:
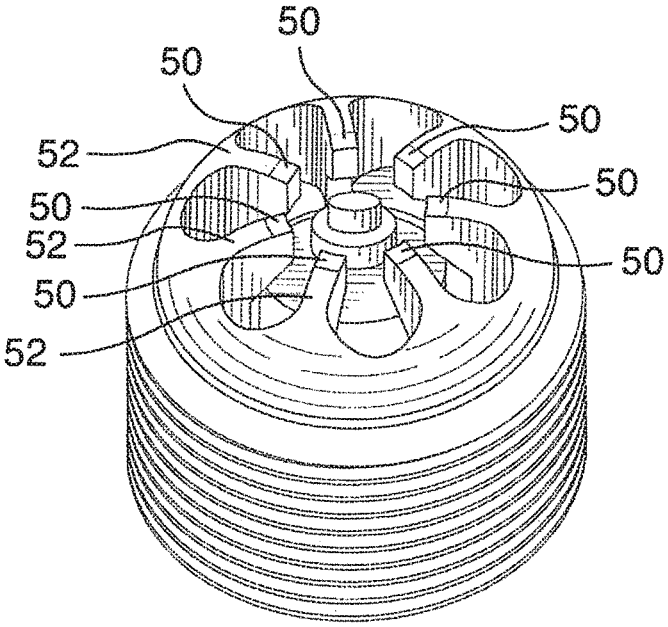
- FIG. 3 is an enlarged view of encircled area 3 of FIG. 1.

More particularly, a spark plug manufacturer that manufactures typical J-leg spark plugs can, simply by adding a 3-axis milling machine, create spark plugs as shown in FIGS. 1-3 with widely varying spark gaps.

The method also has made advantages including, inter alia:

It avoids the need for laser welding the wire

It avoids the need for post-weld should grinding

Eliminates J-gap electrode insert/weld station

It would be understood by a skilled person that the method described herein may be used to form any number of different spark plugs, wherein forming the negative electrode comprises machining the blank having any number of different shapes and/or patterns.

For example, rather than machining the blank to have lobe-shaped openings as seen in FIGS. 1-3 and 13-14, the blank may be machined to form radial blades, as seen in FIGS. 15 to 28, thereby forming an alternative spark plug 200 which forms another aspect of the invention.

Alternative spark plug 200, similar to spark plug 20, will be understood to be for use with an engine block having a threaded bore and also for use with a spark plug wrench and an ignition wire, all as is conventional and not shown.

As seen in FIGS. 15-20, similar to spark plug 20, alternative spark plug 200 includes:

a nut portion 202 adapted to be turned by the wrench;

a coupling portion 204 extending from the nut portion and adapted to receive the ignition wire;

an insulator portion 206 extending from the nut portion and away from the coupling portion to an end;

a positive electrode 208 extending through and beyond the end of the insulator portion; and an alternative ground electrode 210.

Alternative ground electrode 210 includes a tubular portion 212 extending from nut portion 202 in surrounding relation to insulator portion 206. Tubular portion 212 is orientated coaxially about insulator portion 206 and defines a longitudinal axis X. Tubular portion 212 is further externally-threaded for engagement in the threaded bore in said engine block in use.

Figure 17:
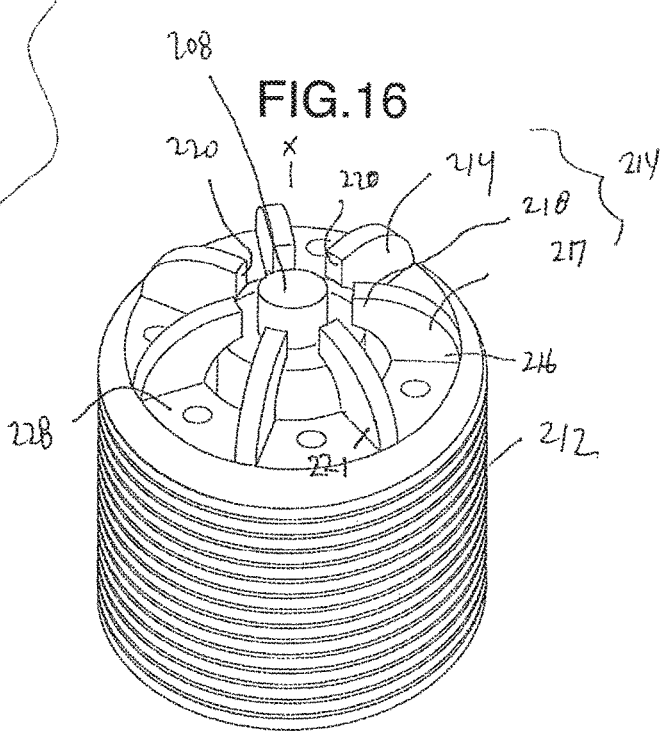
FIG. 17 is an enlarged view of the structure of encircled area 17 of FIG. 15.
Figure 18:
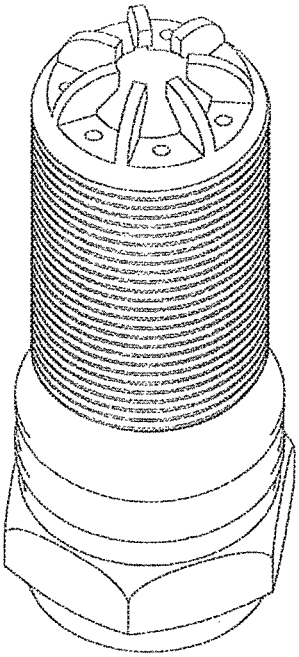
FIG. 18 is an enlarged view of a portion of the structure of encircled area 18 of FIG. 15.
Figure 19:
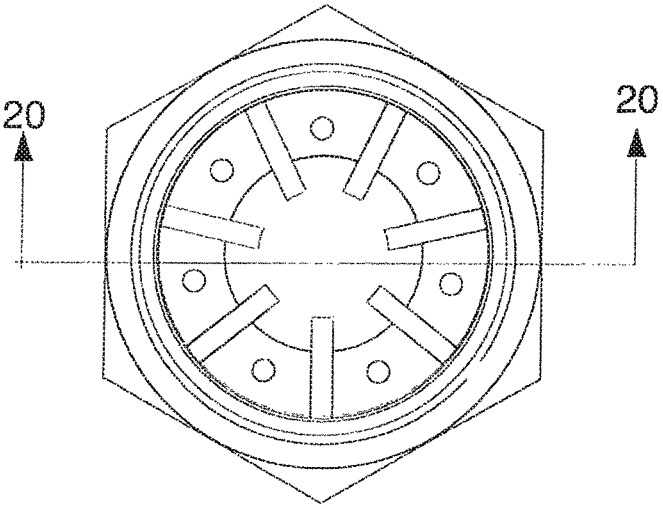
FIG. 19 is a top view of the structure of FIG. 18.

Alternative ground electrode 210 further comprises a plurality of blades 214, each extending generally perpendicularly from tubular portion 212 and projecting radially inward towards longitudinal axis X, radially spaced from positive electrode 208. Each of the plurality of blades 214 has a fixed end portion 216, and a body 217 extending to a free end portion 218. Each free end portion 218 defines a face cross-sectional area 220 presenting towards positive electrode 208. Each fixed end portion 216 defines abase cross-sectional area 221, which is integrally formed with portion 212, as indicated in FIG. 17.

Figure 20:
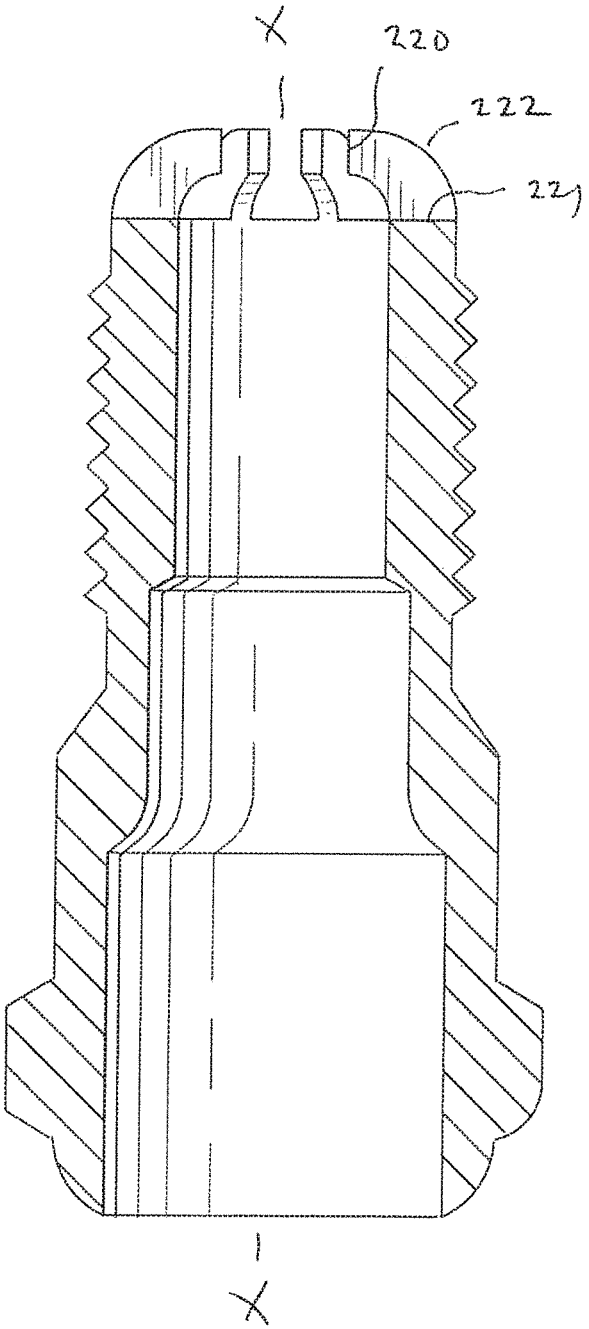
FIG. 20 is a view along section 20-20 of FIG. 19.
Figure 21:
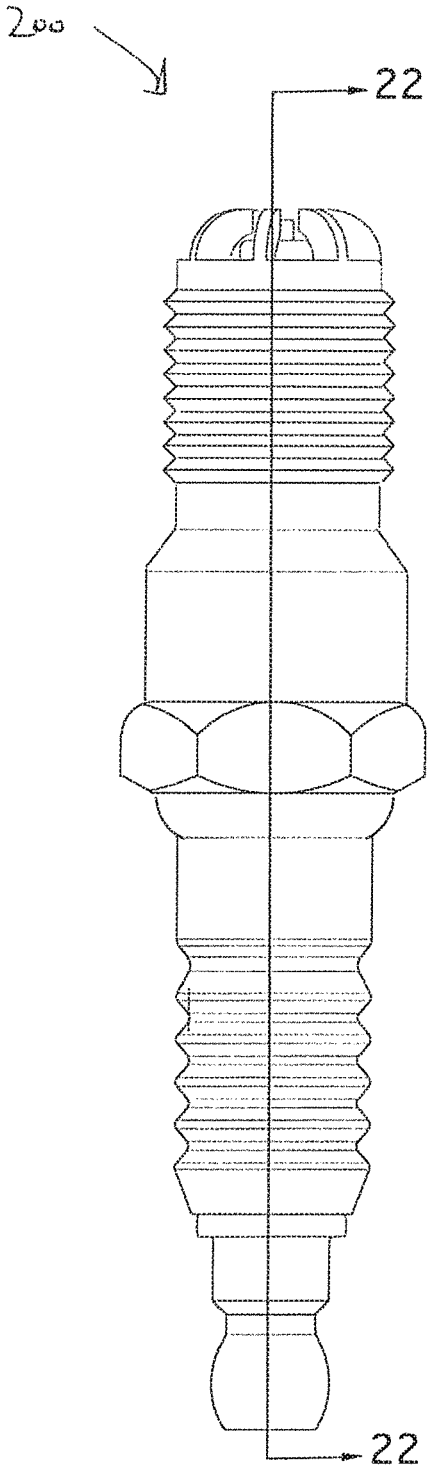
FIG. 21 is a side view of the structure of FIG. 15.
Figure 22:
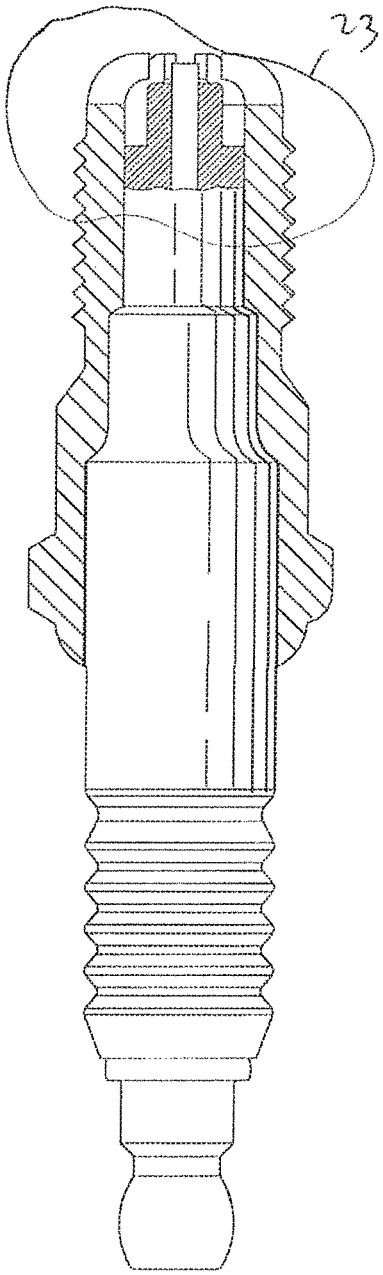
FIG. 22 is a view along section 22-22 of FIG. 21.
Figure 23:
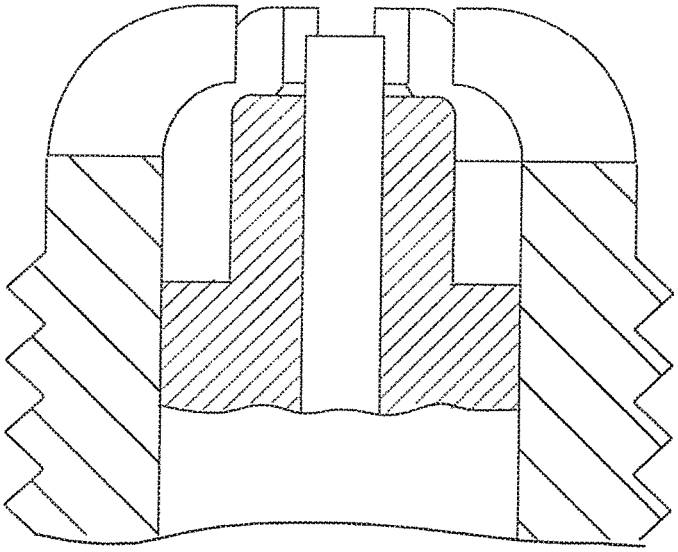
FIG. 23 is an enlarged view of the structure of encircled area 23 of FIG. 22.
Figure 24:
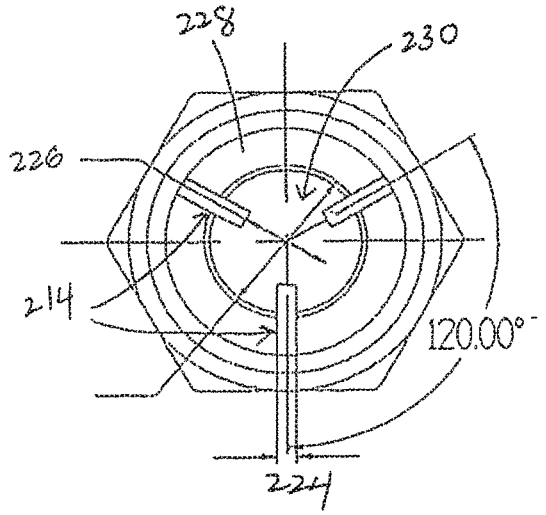
FIG. 24 is a top plan view of an improved spark plug according to another exemplary embodiment of the present invention.
Figure 25:
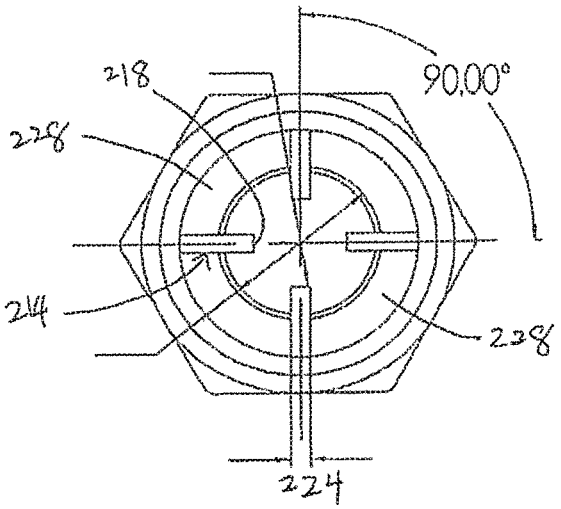
FIG. 25 is a top plan view of an improved spark plug according to another exemplary embodiment of the present invention.
Figure 26:
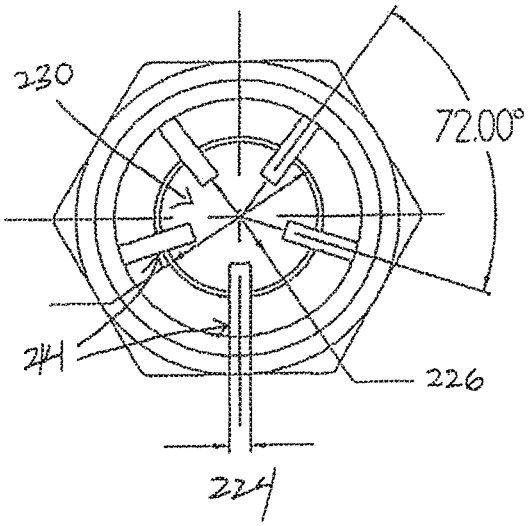
FIG. 26 is a top plan view of an improved spark plug according to another exemplary embodiment of the present invention.
Figure 27:
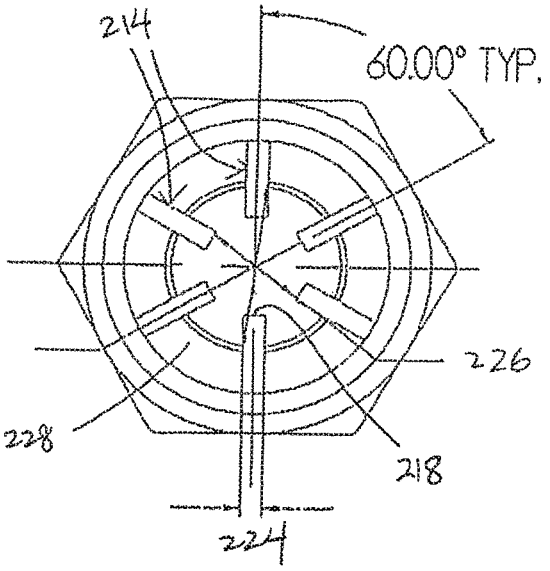
FIG. 27 is a top plan view of an improved spark plug according to another exemplary embodiment of the present invention.
Figure 28:
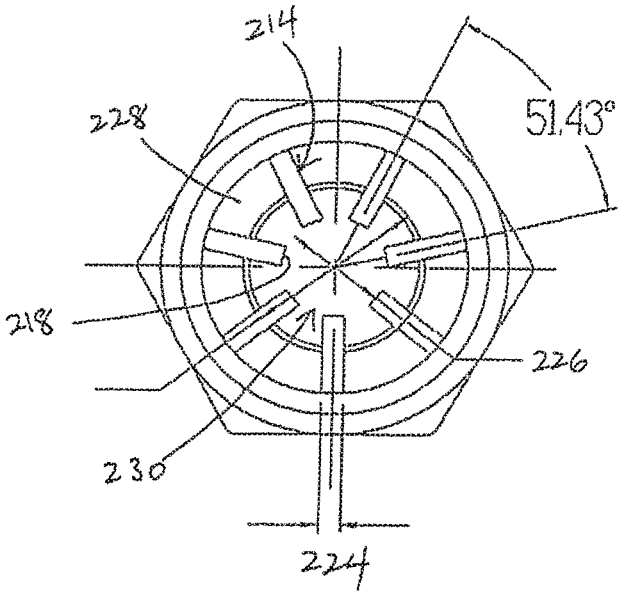
FIG. 28 is a top plan view of an improved spark plug according to another exemplary embodiment of the present invention.

As best seen in FIG. 20, face cross-sectional area 220 of free end portion 218 is less than base cross-sectional area 221 of the corresponding fixed end portion 216. As also see in the Figures, the cross sectional area of each of the plurality of blades generally increases from face cross-sectional area 220 to corresponding base cross-sectional area 221. As shown, the blade of each of the plurality of blades is generally arcuate in shape and has a convex surface 222 that extends from face cross-sectional area 220 to base cross-sectional area 221.

Body 217 of each of plurality of blades 214 further comprises a pair of parallel planes 224 which define a thickness of blade 214. In the embodiment depicted, the thickness of each blade 214 is 0.038 inches.

Alternative spark plug 200 may comprise any one of three to seven blades 214, evenly spaced about the longitudinal axis. The embodiment shown in FIG. 24 comprises three blades 214. The embodiment shown in FIG. 25 comprises four blades 214. The embodiment shown in FIG. 26 comprises five blades 214. The embodiment shown in FIG. 27 comprises six blades 214. And the embodiment shown in FIG. 28 comprises seven blades 214.

Face cross-sectional area 220 of plurality of blades 214 also define a generally cylindrical space 226. In the particular embodiments depicted, cylindrical space 226 has a diameter of 0.185 inches.

According to the depicted embodiment, tubular portion 212 comprises a ring 228 from which plurality of blades 214 extends. Ring 228 defines an opening 230 through which positive electrode 208 extends. In the particular embodiment depicted, ring 228 has an inner diameter of 0.321 inches.

An advantage of the described park plug 200 is that the blades may be used to replace an OEM spark plug manufacturer's spark plug body without altering the critical heat range properties of the selected spark plug. Below are heat range test results of spark plugs according to the present invention having three, five and seven blades.

Whereas specific embodiments of a method for forming a spark plug and a spark plug are illustrated, numerous variations are possible.

Accordingly, the invention should be understood to be limited only by the accompanying claims, purposively construed.

The invention claimed is:

1. An improved method for constructing a spark plug, the spark plug being of the type including:

a metal shell having a hex nut, a seat, a flange, a bore and threads;

a negative electrode associated with the shell; and an insulator assembly occupying the and gripped by the flange, the method comprising the steps of:

forming the hex nut and the seat by carrying out operations on a blank;

rolling the threads;

fitting the insulator assembly into the bore;

deforming the flange to capture the insulator assembly; and forming the negative electrode by machining the blank.

2. The method according to claim 1, wherein the negative electrode including a cap portion to which the threaded part of the shell extends and which is disposed in spaced relation to a portion of the insulator assembly, the cap portion defining a void having:

a central portion into which the positive electrode extends;

an annular channel surrounding the central portion; and a plurality of segments, equally spaced about the positive electrode and each extending radially outwardly from the annular channel having:

a central surface axially spaced from that portion of the insulator that protrudes beyond a tubular portion; and a convex surface that surrounds and extends to the central surface.

3. The method according to claim 2, wherein the central surface is oriented substantially perpendicular to the longitudinal axis and substantially coplanar with the end of the positive electrode.

4. The method according to claim 3, further comprising providing a plurality of segments consisting of three to seven segments.

5. The method according to claim 4, further comprising defining the plurality of segments by a plurality of lobes, each being positioned with respect to the central portion in a manner analogous to the placement of the planet gears with respect to the sun gear in a planetary gear.

6. The method according to claim 5, wherein the plurality of lobes consist of seven lobes.

7. The method according to claim 5, further comprising machining the negative electrode with a 3-axis milling machine.

8. A spark plug for use with an engine block/cylinder head having a threaded bore and also for use with a spark plug wrench and an ignition wire, the spark plug comprising:

a nut portion adapted to be turned by the wrench;

a coupling portion extending from the nut portion and adapted to receive the ignition wire;

an insulator portion extending from the nut portion and away from the coupling portion to an end;

a positive electrode extending through and beyond the end of the insulator portion; and a negative electrode including a tubular portion extending from the nut portion in surrounding relation to the insulator portion, the tubular portion being oriented coaxially about and defining a longitudinal axis and further being externally-threaded for engagement in the threaded bore in said engine block in use; and a plurality of blades, each blade:

having a fixed end portion, defining a base cross-sectional area, integrally formed with the tubular portion;

having a body extending axially away from the fixed end portion, and hence projecting radially inward towards the longitudinal axis;

having a free end portion to which the body extends, the free end portion defining a face cross-sectional area presenting towards the positive electrode, which is less than the base cross-sectional area; and being radially spaced from the positive electrode.

9. The spark plug according to claim 8, wherein the cross sectional area of each of the plurality of blades generally increases from the face cross-sectional area to the base cross-sectional area.

10. The spark plug according to claim 8, wherein the body of each of the plurality of blades is generally arcuate in shape and has a convex surface that extends from the face cross-sectional area to the base cross-sectional area.

11. The spark plug according to claim 8, wherein the body of each of the plurality of blades comprises pair of parallel planes defining a thickness of the blade.

12. The spark plug according to claim 11, wherein the thickness of each blade is 0.038 inches.

13. The spark plug according to claim 8, wherein the plurality of blades comprises any of three to seven blades.

14. The spark plug according to claim 13, wherein each of the plurality of blades is evenly spaced about the longitudinal axis.

15. The spark plug according to claim 8, wherein the faces of the plurality of blades defines a central, generally cylindrical space, the cylindrical space having a diameter of 0.185 inches.

16. The spark plug according to claim 8, wherein each of the plurality of blades extends generally perpendicularly from the tubular portion.

17. The spark plug according to claim 8, wherein the tubular portion comprises a ring from which the plurality of blades extends, the ring defining an opening through which the positive electrode extends.

18. The spark plug according to claim 17, wherein the ring has an inner diameter of 0.321 inches.

* * * * *